US006644424B1

(12) United States Patent
Fanuel

(10) Patent No.: US 6,644,424 B1
(45) Date of Patent: Nov. 11, 2003

(54) CORE BARREL

(75) Inventor: Philippe Fanuel, Brussels (BE)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/936,654

(22) PCT Filed: Mar. 15, 2000

(86) PCT No.: PCT/BE00/00024

§ 371 (c)(1),
(2), (4) Date: Sep. 14, 2001

(87) PCT Pub. No.: WO00/55473

PCT Pub. Date: Sep. 21, 2000

(30) Foreign Application Priority Data

Mar. 15, 1999 (BE) ..... 09900180

(51) Int. Cl.[7] ..... E21B 25/00
(52) U.S. Cl. ..... 175/252; 175/250; 175/236
(58) Field of Search ..... 175/20, 107, 58, 175/236, 244, 246, 249, 250, 252

(56) References Cited

U.S. PATENT DOCUMENTS

| | | | | |
|---|---|---|---|---|
| 3,704,755 | A | * | 12/1972 | Wolda |
| 3,777,782 | A | * | 12/1973 | Wolda |
| 3,799,277 | A | * | 3/1974 | Kellner |
| 3,874,466 | A | | 4/1975 | Fulford |
| 4,875,531 | A | | 10/1989 | Biehl et al. |
| 5,592,994 | A | | 1/1997 | Laporte et al. |

FOREIGN PATENT DOCUMENTS

| | | |
|---|---|---|
| CA | 1012530 | 6/1977 |
| CA | 1296319 | 2/1992 |
| CA | 2138201 | 10/1995 |
| DE | 2507220 | 10/1975 |
| DE | 3701914 | 5/1988 |
| EP | 0276724 | 8/1988 |
| GB | 1475632 | 6/1977 |
| JP | 50137302 | 10/1975 |
| SE | 412430 | 3/1980 |

* cited by examiner

*Primary Examiner*—Roger Schoeppel
(74) *Attorney, Agent, or Firm*—Carlos A. Torres; Browning Bushman, P.C.

(57) ABSTRACT

The invention concerns a core barrel, in particular for oil exploration, comprising a string, an external tube (2) fixed at the front end of the string, a core bit mounted on a front section (3A) of the external tube, and an internal tube assembly (8) mounted in the external tube and comprising hydrodynamic means transforming a core sampling line pressure into a load thrusting said assembly towards the core barrel front, the front section of the external tube being mounted axially sliding, limited by front and rear stop elements (12A, 12P), in a rear section (3P) of the same external tube to project therefrom longitudinally, the assembly comprising a support stop (14) arranged to thrust selectively forward the front section of the external tube, means being arranged between the inner tube (9) proper and said front section such that the latter can be driven in rotation about its longitudinal axis independently of said internal tube, a motor (7) capable of driving the core bit in rotation relative to the string.

33 Claims, 4 Drawing Sheets

CORE BARREL

FIELD OF THE INVENTION

The present invention concerns a core barrel, in particular for oil exploration, the core barrel having a string, an external tube fixed to the front end of the string, from the point of view of forward travel of the core barrel in a formation, an annular core bit mounted on a front portion of the external tube, and an internal tube assembly, which is mounted in "wire line" mode, that is to say mounted in the external tube so as to be able to be retrieved and brought to the surface again through the string, and which has hydrodynamic means arranged to transform a core sampling fluid pressure flowing in the string into a force thrusting said assembly towards the front of the core barrel.

BACKGROUND OF THE INVENTION

There is a pressing need to improve this type of core barrel, particularly for its use in wells with portions inclined with respect to the vertical or more particularly with horizontal portions, all the more so when these portions are at a great distance from the vertical entry portion of the well. It is in fact known that, in this case, the string is subjected at least locally to compression and therefore to a risk of buckling amplified by an inclined or horizontal positioning. This situation causes the string to rub unnecessarily against the wall of the well, and therefore to wear, to be checked in its forward movement and, where applicable, in its rotation driving the bit.

The purpose of the present invention is to propose a solution to the problem set out above and thus to procure a core barrel on which it is possible for the bit not to be constantly pushed directly by the string, particularly in the horizontal position, for its forward movement in a formation but can be pushed particularly by the pressure of the coring fluids sent to the bottom of the well through the string, the bit however being able to be held up, if necessary, in its advance by this string.

SUMMARY OF THE INVENTION

To this end, the core barrel mentioned at the start has according to the invention the following particularities: the front portion of the external tube is mounted for axial sliding, limited by front and rear stops, in a rear portion of the same external tube and projects therefrom longitudinally; the internal tube assembly has a support stop arranged to selectively push forward the front portion of the external tube, and means are arranged between the internal tube proper and the said front portion of the external tube so that the latter can be driven in rotation about its longitudinal axis independently of said internal tube, the latter being able to be held fixed in rotation with respect to the formation during core sampling.

Through this arrangement of the core barrel of the invention, the bit is pushed by the internal tube assembly in the formation to be sampled as long as the front portion is not in abutment against one or other of the stops. Because of this, at least part of the string is not subjected to buckling and is substantially less pressed against the wall of the well being sampled, for example in a bend therein, which would not be the case in a normal core barrel configuration.

According to a preferred embodiment of the core barrel of the invention, the latter has, for rotating the front portion of the external tube and the bit, a motor mounted in a rear part of the internal tube assembly. Means are then arranged between the front and rear portions of the external tube so that one can be driven in rotation about its longitudinal axis independently of the other. The motor stator can be fixed in rotation with respect to the rear portion of the external tube, during core sampling, whilst the motor rotor is then fixed in rotation to the front portion of the external tube.

Through these measures, the string and the rear portion of the external tube are appreciably less subject to wear and to fatigue due to stresses of the type caused by alternating bending of the tubes turning in curves of the well. In addition, the evenness of the rotation of the bit thus driven by the motor is greater than that which would be provided by the string since there is no interference from a rubbing of the strings against the wall of the well.

Advantageously, the motor stator can be kept fixed in rotation with respect to the rear portion of the external tube by at least one assembly consisting of a catch and a corresponding longitudinal groove. Likewise, the rotor can be kept fixed in rotation with respect to the front portion of the external tube also by at least one assembly consisting of a catch and corresponding longitudinal groove. One or other or both of the catches can then be arranged so as to come into engagement in a corresponding groove or to be released therefrom automatically when the internal tube assembly is put in the core sampling position in the external tube or is respectively withdrawn therefrom. This design allows easier fitting and removal of the internal tube assembly in the external tube.

Other technically equivalent means can be used in place of the catch and groove assemblies, such as for example reciprocal flutes.

The motor is preferably of a type actuated by the core sampling fluid, for example a PDM (Positive Displacement Motor) or a turbine known in the art. In this case, the motor can participate in the aforementioned hydrodynamic means, at least for the part of said fluid which actuates it and which is therefore subjected to a pressure drop.

One advantage of a PDM or particularly of a turbine is to be seen in its high rotation speed, and therefore in an advantageous rate of advance, in particular in the case of hard rocks for which preferably bits of the impregnated type or concretion type are preferably used. However, given the small diameter imposed on this type of motor in order to be able to pass through the external tube of the core barrel of the invention, it may be appropriate to choose an extended type or one with several stages in order to obtain sufficient power at the bit. This does not however constitute a handicap since there is a means of easily organising space longitudinally for this purpose.

In one embodiment of the invention, the core barrel can have, to help the internal tube assembly to descend in the external tube, a joint system mounted on the internal tube assembly so as to substantially completely close the annular space between this assembly and the external tube and thus to receive, like a piston, the full pressure and full flow of drilling fluid. Then the joint system can have at least two flat circular joints, whose external edge is divided into a kind of petal, the two joints being arranged one on the other so that a petal on one joint covers a gap between two petals on the other joint.

The core barrel of the invention is thus advantageously arranged to function according to two modes. There is a decoupled mode in which the front portion of the external tube slides freely during core sampling with respect to the string and the rear portion, under the thrust of the internal tube assembly, with the advantages explained above and the additional advantage that variations in the progress of the string in the well are no longer transmitted to the bits. There is also a coupled mode in which the internal tube assembly pulls by means of stops on the rear external tube portion and therefore on the string. At least part of the string then being under traction, and this is advantageous from the point of view of wear and the directional behaviour of complete assembly in the well.

Other details and particularities of the invention will emerge from the accompanying claims and the description of the core barrel of the invention, given below by way of non-limitative example, making reference to the accompanying drawings.

In the different figures, the same references designate similar or analogous elements.

DETAILED DESCRIPTION OF THE INVENTION

Figure 1:
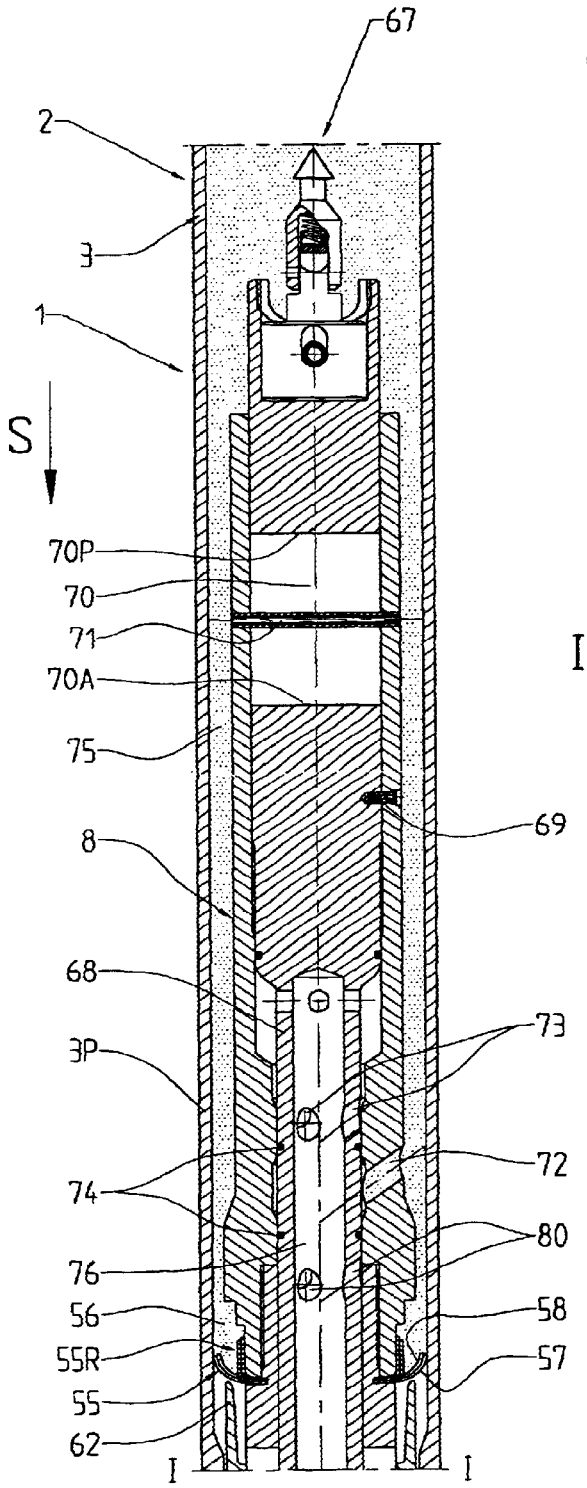
FIG. 1 shows in axial section a portion of a core barrel of the invention at a point of attachment of the means of retrieving the internal tube assembly.

The core barrel 1 of the invention has, as is known (FIGS. 1 and 3), a string 2, an external tube 3 fixed to the front end of the string 2, looking in a direction of advance S of the core barrel 1 in a formation 4 (FIG. 7), an annular core bit 5 mounted on a front section 3A of the external tube 3, and an internal tube assembly 8, including amongst other things the internal tube 9 proper. This assembly 8 is designed to be lowered in the external tube 3 and to be brought to the surface again through the string 2 and has hydrodynamic means arranged to convert the pressure of the core sampling fluid flowing in the string 2 into a force thrusting the said internal tube assembly forwards. These hydrodynamic means consist amongst other things of the different surfaces of the internal tube assembly 8 subjected to different pressures which the core sampling fluid exhibits, both along this assembly 8 and at its ends, because of pressure drops which occur therein, as is known in the art, these different pressures decreasing as the bit 5 is approached. These pressure drops can be controlled in the assembly and can be regulated, for example by adapting an appropriate exchangeable nozzle 10 (FIG. 2) in a pipe 11 through which the fluid runs.

According to the invention, the front section 3A (FIGS. 6 and 7) of the external tube 3 is mounted for axial sliding, limited by reciprocal stops, front 12A, 12P (FIG. 6 or 7) and rear 13A, 13P (FIG. 7), in a rear section 3P of the same external tube 3, and projects longitudinally therefrom. The stops 12A and 13A are fixed with respect to the front section 3A whilst the stops 12P and 13P are fixed with respect to the rear section 3P. The latter can form a kind of sheath for the front section 3A, as shown in FIG. 7. It goes without saying that an expert can choose to dispose the stops 12A, 12P either in accordance with FIG. 6 or in accordance with FIG. 7 or again according to any other corresponding embodiment.

In addition, the internal tube assembly 8 has a support stop 14 arranged so as to selectively push the front section 3A of the external tube 3 forwards. In addition, means 15 described below are arranged between the internal tube proper 9 (intended to receive a core) and said front external tube section 3A so that the latter can be driven in rotation about its longitudinal axis independently of said internal tube 9, the latter being able to be kept fixed in rotation with respect to the formation 4, during core sampling.

The bit 5 of the core barrel 1 can be driven in rotation by means of the external tube 3 and the string 2. It is however preferred for the core barrel 1 to have a motor 17 for rotating the front section 3A and the bit 5. In this case, means, for example of the rotation and sliding bearing raceway 18 type (FIGS. 6 and 7), are arranged between said front section 3A and the rear section 3P of the external tube 3, so that one section can be driven in rotation, about its longitudinal axis, independently of the other. The motor 17 is advantageously mounted in a rear part 19 (FIG. 6) of the internal tube assembly 8. The stator 20 of the motor 17 can be fixed in rotation with respect to the rear section 3P of the external tube 3, during core sampling, whilst the rotor 21 of this motor 17 is fixed in rotation to the front section 3A of the external tube 3.

In the internal tube assembly 8, the internal tube 9 proper can be supported by the rotor 21 of the motor 17, by means 18 which can be a thrust ball bearing assembly 15, to allow the independent rotation of the internal tube 9 with respect to the rotor 21.

Figure 4:
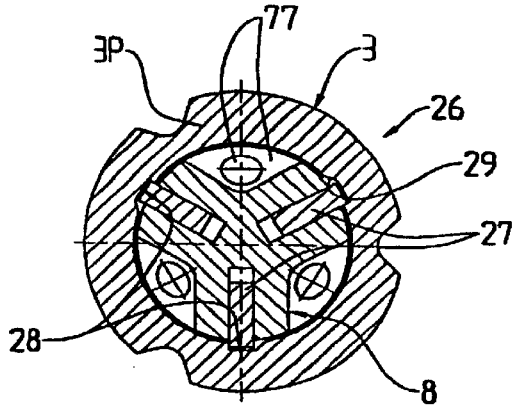
FIG. 4 shows a transverse section, at the cutting plane IV—IV in FIG. 2, seen in the direction of the arrows.

The stator 20 of the motor 17 can be kept fixed in rotation with respect to the rear section 3P of the external tube 3 (FIGS. 2 and 4) by at least one assembly 26 consisting of catch 27 and corresponding groove 28. The catch 27 is then advantageously arranged to engage in the groove 28 or to be automatically released therefrom when the internal tube assembly 8 is put in the core sampling position in the external tube 3 or is respectively withdrawn therefrom. Three assemblies 26 can advantageously be arranged around the longitudinal axis of the assembly 8 and the core barrel 1.

For its part, the rotor 21 can be coupled in rotation to the front section 3A of the external tube 3 (FIG. 6) by at least one assembly 31 consisting of catch 32 and corresponding groove 33, the catch 32 is then advantageously arranged to engage in the groove 33 or to be automatically released therefrom during the same manoeuvre of putting in the core sampling position or respectively of withdrawal as above of the internal tube assembly 8. The assemblies 31 can be disposed three in number, in a similar manner to the assemblies 26 in FIG. 4.

Figure 2:
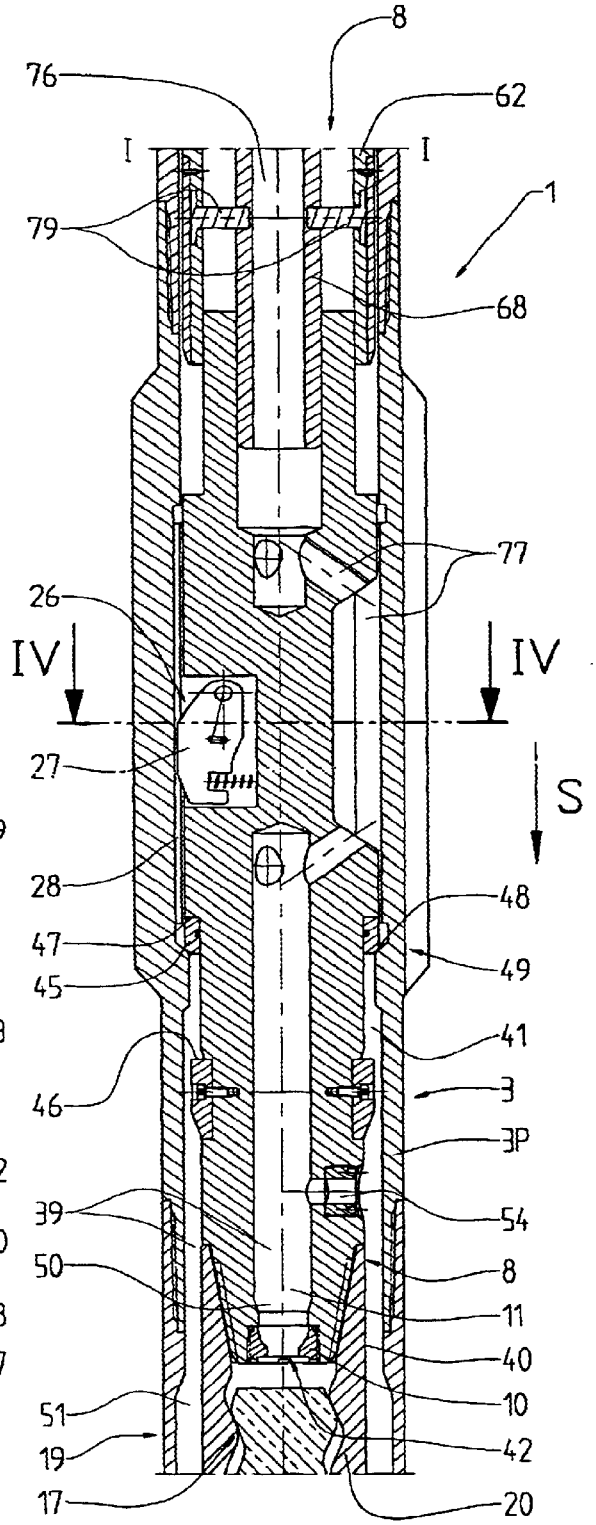
FIG. 2 shows an axial section of a portion of the core barrel of the invention which follows that of FIG. 1, tying in with it at a transverse plane I—I, going towards the bit.
Figure 6:
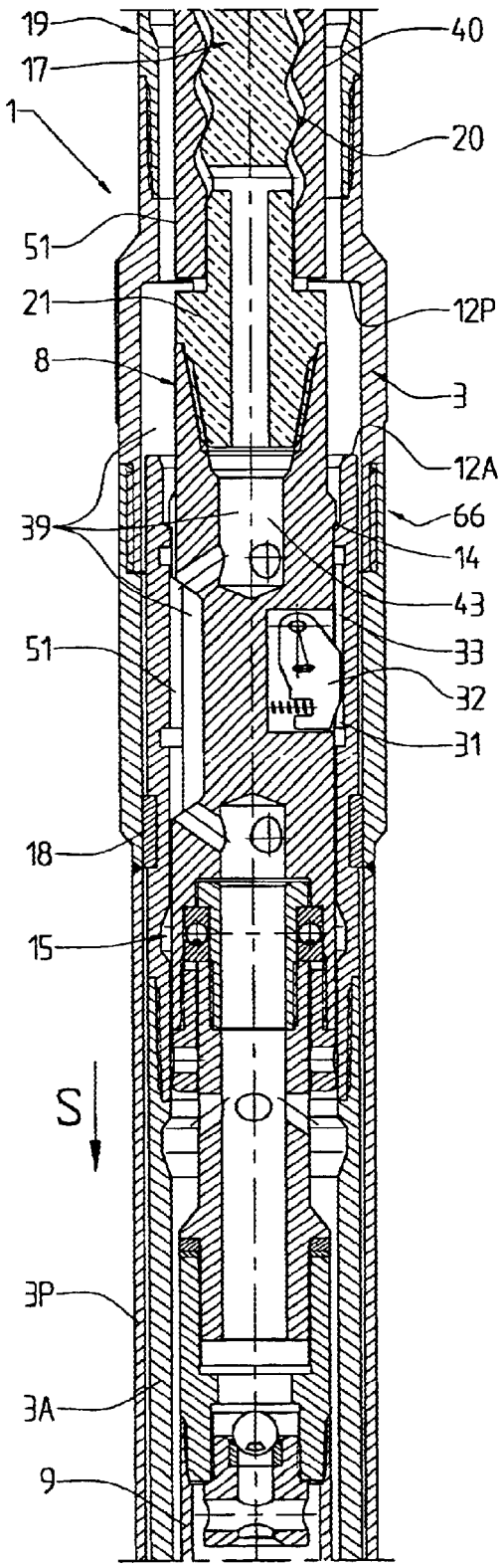
FIG. 6 shows an axial section of a portion of the core barrel of the invention which follows that of FIG. 2, going towards the bit.
Figure 7:
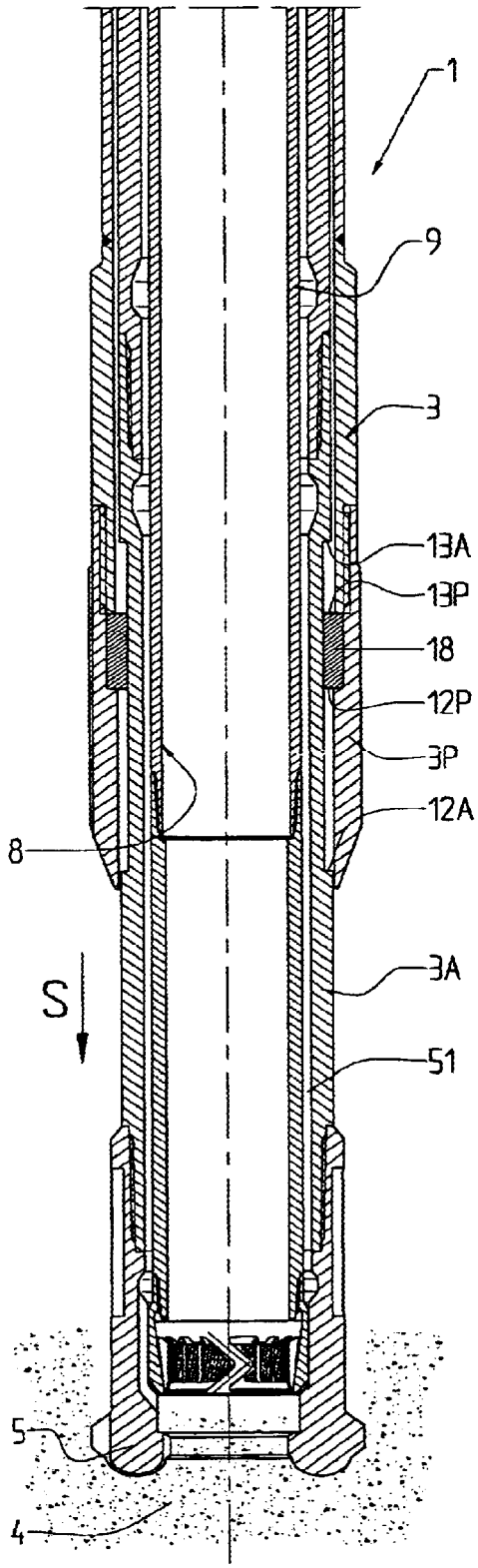
FIG. 7 shows in axial section a portion of a core barrel of the invention downstream of the one in FIG. 6 and at the bit.

The catches 27 and 32 can have springs, stops and bevels depicted in FIGS. 2 and 6, in order to facilitate their introduction into the grooves 28 and respectively 33 and their removal therefrom. The grooves 28 (FIG. 4) and 33 can for their part have a longitudinal face (for example 29) sloping in order to assist a gentle entry of the catches 26 and respectively 32 into the appropriate groove by a rotation of the assembly 8 or respectively of the rotor 21 in the clockwise direction in the rear section 3P or respectively front section 3A.

Figure 3:
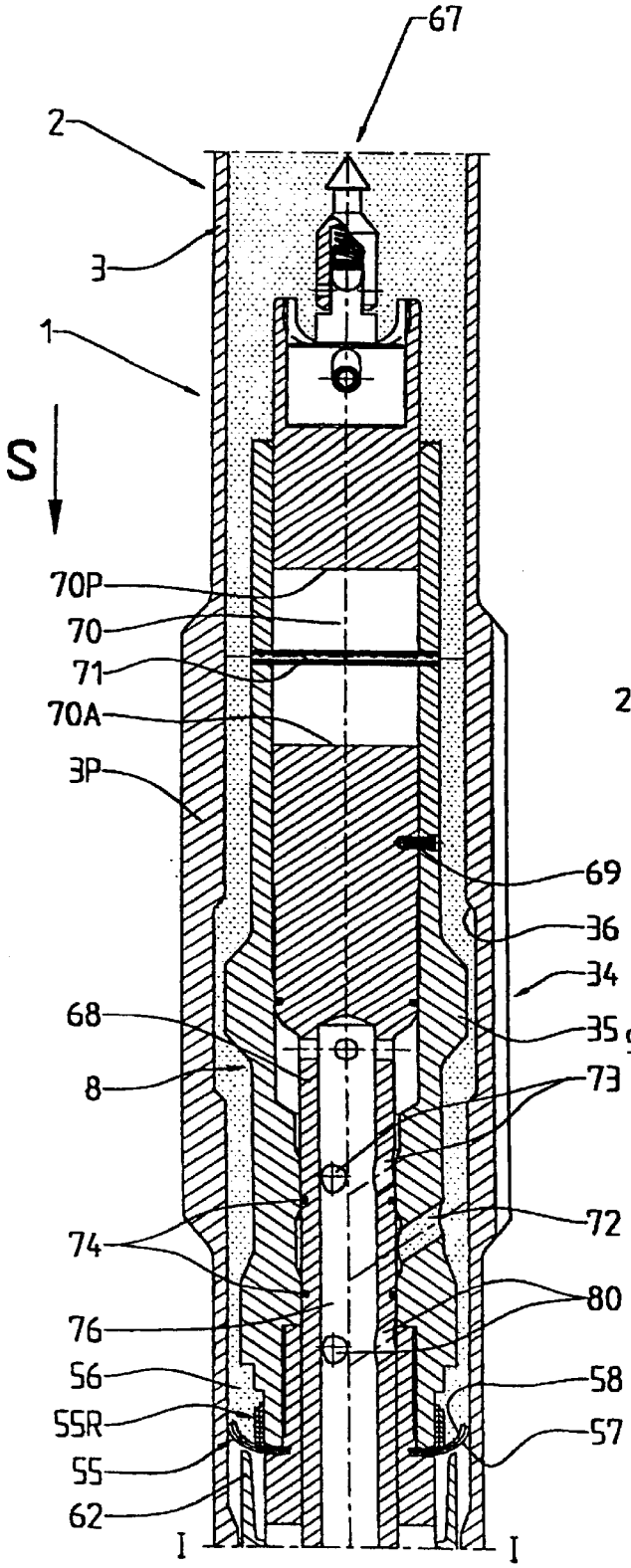
FIG. 3 shows in axial section, as a variant to that of FIG. 1, another type of portion of a core barrel of the invention at the point of attachment of the means of retrieving the internal tube assembly.

Cooperating means 34 for throttling the passage of core sampling fluid can be provided on the internal tube assembly 8 and in the external tube 3 (FIG. 3). These throttling means 34 are arranged so as to be inactive during normal core sampling and so as to throttle the said passage where the internal tube assembly 8 is pushed back in the external tube 3 in the opposite direction to the direction of forward travel S of the core sampling. For this purpose, these throttling means 34 are formed for example by an annular protrusion 35 on the internal tube assembly 8 and by a corresponding internal annular rim 36 on the external tube 3. These throttling means 34 are designed to indicate for example an abnormal situation during core sampling, as is described below.

The motor 17 is advantageously of a type actuated by the core sampling fluid. In this case, the motor 17 can be arranged in the system of pipes 39 (FIGS. 2 and 6) for the passage of fluid so that it participates in the aforementioned hydrodynamic means, at least for the part of the said fluid which it actuates.

A bypass pipe 41 (FIG. 2) for core sampling fluid can be provided in the system of fluid pipes 39, between an inlet 42 and an outlet 43 of the motor 17 for this fluid. Then, on the one hand, it is possible to equip the internal tube assembly 8 with a valve 45 mounted, in the bypass pipe 41, so that it can slide longitudinally between two stop positions, a front one 46 and a rear one 47 on said assembly 8. The front stop 46 can consist, for example, for a construction facility, of two half rings as suggested in FIG. 2. On the other hand, in the same bypass pipe 41, the rear section 3P of the external tube 3 can be provided with a valve seat 48 which is fixed to said rear section 3P, downstream of the valve 45, and which is arranged to cooperate with the latter as follows.

On the one hand, the bypass pipe 41 is closed when the valve 45 is in the rear stop position 47 depicted in FIG. 2 and is applied at the same time against the said seat 48 by the weight of the internal tube assembly 8 and, where applicable, by the pressure of the fluid on this assembly 8 or when the valve 45 slides on this same assembly 8, between the front 46 and rear 47 stop positions, but is applied at the same time against the said seat 48 by the pressure of the fluid upstream in the bypass pipe 41. The motor 17 can then receive maximum pressure and throughput of the core sampling fluid and produce its maximum torque for driving the bit 5.

Moreover, the bypass pipe 41 is open when the valve 45 is in the front stop position 46 and is moved away at the same time from the said seat 48 by the effect of the internal tube assembly 8 pushed upstream in the rear section 3P of the external tube 3. The motor 17 is then in some way put in short-circuit with regard to the fluid which actuates it and has consequently practically no more driving torque.

In the case of the example shown in FIG. 2, it can be seen that the rear stop 47, the valve 45 and the valve seat 48 form a stop 49 which longitudinally positions, in the direction of forward travel S, the above-mentioned assembly 8 in the external tube 3 and more precisely in the rear section 3P thereof. Another kind of stop can however be used for the same purposes.

Between a supply pipe 50 to the motor 17 and an outlet pipe 51 (FIGS. 2, 6 and 7) for the core sampling fluid to the bit 5, a closure valve 54 can advantageously be mounted, arranged so as to open in the event of overpressure of the fluid at the inlet 42 to the motor 17, this closure valve 54 preferably being a rated disc 54 which is pierced at a given overpressure.

In order to help the internal tube assembly 8 to descend in the external tube 3, the core barrel 1 of the invention can also include (FIGS. 1 and 3) a joint system 55 mounted on the internal tube assembly 8 so that, in the active position, it substantially completely closes the annular space 56 between the external tube 3 and this assembly 8 and thus receives, like a piston, the full pressure of the core sampling fluid.

Figure 5:
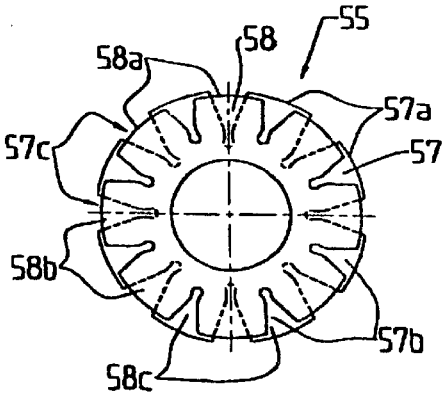
FIG. 5 shows in a plan view a joint system used in an embodiment of the invention.

The joint system 55 can include at least two flat circular joints 57 and 58, the external edge 57*a*, 58*a* (FIG. 5) of which is in each case divided into a kind of petal 57*b*, 58*b*, the two joints 57, 58 being arranged one on the other so that a petal 57*b* or 58*b* on one joint covers a gap 58*c* or respectively 57*c* between two petals on the other joint.

The internal tube assembly 8 can advantageously have a sleeve 62 disposed downstream of the joint system 55 so as to be without action thereon during the descent of the internal tube assembly 8 in the external tube 3 and during core sampling, but so as to slide in advance upstream on the internal tube assembly 8 when the latter is withdrawn from the external tube 3. During this sliding, the sleeve 62 comes into engagement with the joint system 55 and then moves it away from the external tube 3 in a position 55R folded back against the internal tube assembly 8, so that the fluid can once again flow through the annular space 56, having a vastly reduced or practically zero effect on the joint system 55 and therefore on the said assembly 8.

It should be understood that the present invention is in no way limited to the embodiments described above and that many modifications can be made without departing from the scope of the claims given below.

Figure 8:
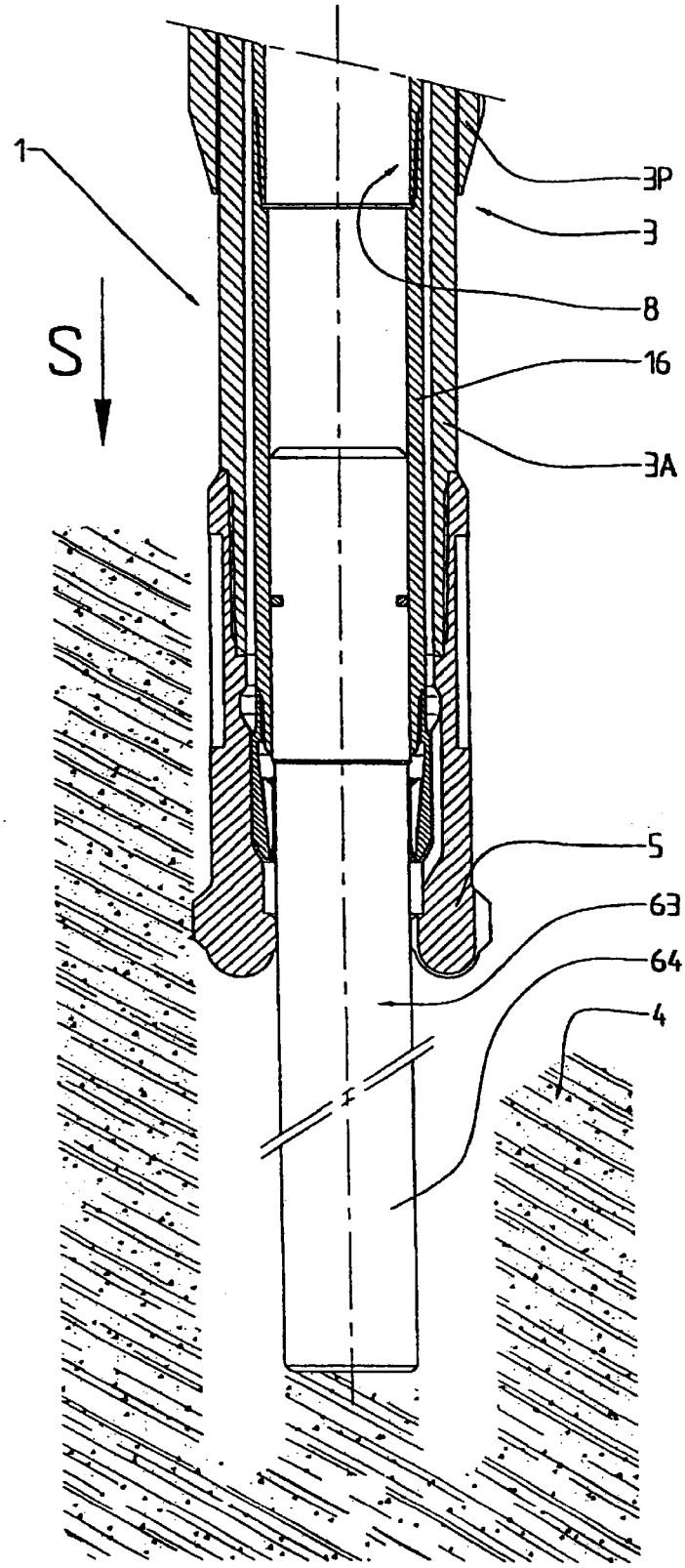
FIG. 8 shows in axial section a variant of the end of the core barrel portion in FIG. 7.

Thus it is advantageously possible to equip the core barrel 1 of the invention with a sensor 63 (FIG. 8) disposed in the internal tube proper 9. A portion 64 of this sensor 63, equipped with measuring means, not shown nor described in detail since they are known to experts, then projects from this internal tube 9 during the descent of the internal tube assembly 8 in the external tube 3 and in the core sampling position of the internal tube proper 9 with respect to the external tube 3 whilst the latter is still at a distance from a core sampling well bottom. The sensor 63 is also disposed in the internal tube 9 so as to be able to be pushed inside it, during core sampling, by the bottom of the well and/or by the top of the core. This type of sensor 63 can have means of recording the measurements made, so that they can be examined on the surface when the assembly 8 has been removed from the well and the sensor 63 has been connected to appropriate equipment.

Modes of functioning of the core barrel of the invention are described below by way of non-limitative examples.

The front section 3A of the external tube 3 is introduced into the rear section 3P, through the rear, before connecting external tube sections 3 to each other at 66 (FIG. 6). It is arranged so as to be able to slide therein between a position of suspension in the rear section 3P, by the reciprocal effect of the stops 13A, 13P (FIG. 7), and an extreme pushed-in position, in the rear section 3P, limited by the reciprocal effect of the stops 12A, 12P (FIG. 6 or 7). The bit 5 can then be mounted on the front section 3A. The external tube 3 thus equipped can be fixed to the string 2 (FIG. 1 or 3) and be lowered into a well to be sampled.

The internal tube assembly 8 can be lowered in the external tube 3, according to the known so-called wire-line technique, if necessary by means of a known attachment device 67 (FIG. 1 or 3) which the assembly 8 has. Core sampling fluid sent at this moment under pressure in the external tube 3 can bear on the joint system 55 in order to help in the lowering of the internal tube assembly 8, especially if the external tube 3 does not only follow a vertical but takes a strong inclination with respect to the vertical, even as far as the horizontal. The internal tube assembly 8 can thus descend until it comes into abutment (FIG. 2) against the aforementioned stop 49. Preferably, in this stopped position, the said assembly 8 is at the same time in abutment, during core sampling, against the support stop 14 (FIG. 6) through which it can act on the front section 3A.

At this moment, the attachment device 67 is forced to push in, in the direction S, a connecting bar 68 (FIG. 1 or 3) in the said assembly 8, causing an immobilisation pin 69 to break, until a face 70P of a recess 70 in the bar 68 comes into abutment against a stop spindle 71. Following the travel thus followed by the bar 68, channels 72 and 73, isolated from each other up till now by joints 74, are put in communication and core sampling fluid can flow as from this moment from the inside of the string 2, through the annular space 75 and the channels 72, 73, into a pipe 76 (FIG. 1 or 3, and FIG. 2) hollowed out in the connecting bar 68, in pipes 77, as far as the bit 5. On this path, the fluid undergoes, from at least the top end of the internal tube assembly 8 as far as its exit from the bit 5, a useable pressure drop.

In one mode of functioning, the front section 3A is driven in rotation by the rear section 3P by means, not shown but known to experts, which allow the aforementioned sliding. At the start of core sampling, the bit 5 can, where applicable, partially push the front section 3A into the rear section 3P until it is in abutment against the support stop 15 of the internal tube assembly 8. The assembly 8, subjected to the pressure of the fluid, offers to the front section 3A a resistance determined by this pressure which depends amongst other things on the pressure drop produced by the nozzle 10.

On the one hand, during core sampling, said front section 3A, pushed forward by the assembly 8 subjected to the pressure of the fluid, can be pushed to a maximum extent out of the rear section 3P (FIG. 7) against the formation to be sampled, the stops 13A and 13P not necessarily being against each other (this depending on the relative positions thereof and of the stop 49). Already before reaching this first extreme position, a braking of the advance of the string 2 on the surface can cause a retaining of the advance of the bit 5 in the formation by the action of the stop 49 on the assembly 8. Advantageously then, the string 2 is at least partially under traction and therefore held more straight, even on the horizontal, which is not usually possible when it is completely under compression subject because of this to buckling. In addition, the bit 5 receives under these circumstances a weight which is appreciably more even than with a string in the buckling situation and subjected to significant friction against the wall of the well. The bit 5 can therefore progress in the formation 4 with more regularity. All this amongst other things promotes the ability to correctly direct the bit 5.

If on the other hand the front section 3A were pushed back to the maximum extent in the rear section 3P, counter to the pressure on the assembly 8, the stops 12A, 12P (FIG. 6 or 7) coming into contact, it would be possible to obtain a second extreme situation in which an advancement of the string 2 could force the penetration of the bit 5 into the formation 4.

On the other hand, during core sampling, the front section 3A can be maintained in the rear section 3P, by the pressure on the assembly 8, in positions in which the reciprocal stops 12A, 12P on the one hand and 13A, 13P on the other hand are not in respective contact. If in addition the assembly 8 is not in abutment against the valve 45 but the latter is held against its seat 48 by an upstream fluid pressure greater than the downstream one, what can be termed a decoupled functioning mode is obtained. The front 3A and rear 3P sections of the external tube 3 can then slide with respect to each other under the effect of the pressure on the assembly 8. In this case, even if the string 2 advances only in jerks, for example following a temporary sticking to the walls of the well and/or following curves between vertical and horizontal portions of the well, the front section 3A can for its part progress in a regular manner, according only to the action of the bit 5 in the formation 4 during core sampling.

The assembly 8, the front section 3A and the bit 5 can thus move longitudinally in one direction or the other, with respect to the rest of the string 2, depending on whether the speed of the string 2 is less than or greater than that of the bit 5 in the formation 4, and this can be adjusted from the surface by acting on the string 2.

If at present the assembly 8 is pushed further into the external tube 3, the front stop 46 which carries the assembly 8 comes into contact with the valve 45 and can push it away from the valve seat 48. Because of this, the fluid, which up till then could pass only through the pipe 50 (FIG. 2) and the nozzle 10, can now also pass between the valve 45 and its seat 48, and this considerably reduces the pressure drop in the core barrel 1, and therefore the pressure applied to the assembly 8 and consequently the force exerted by the bit 5 on the formation 4. The core barrel 1 of the invention is thus automatically practically put out of service in the event of excessive force to be supplied, to the benefit of its constituents, through a direction action at these at the bottom of the well.

If the variant according to FIG. 3 is applied, it is possible to obtain another type of signalling of a process of functioning of the core barrel 1 of the invention. In this case, when the internal tube assembly 8 is pushed upstream, whether by a core which is blocked in the internal tube 9 (FIG. 7) and which continues to be cut by the bit 5 or whether it is because the front section 3A is pushed into the rear section 3P, the following is obtained at the cooperating throttling means 34 (FIG. 3). As the assembly 8 is pushed back in the external tube 3, the annular protrusion 35 provided on the assembly 8 approaches the annular rim 36 on the external tube 3 and thereby the passage of fluid is throttled therein. This causes, upstream of the means 34, an increase in the pressure of the fluid, which the operators can note and interpret. This can also accentuate the resulting force on at least the assembly 8 and possibly on the front section 3A and on the bit 5 but it is then possible to limit this force from the surface by acting directly on the fluid flow or, preferably, on the advance of the string 2.

When the front section 3A and the bit 5 are not driven in rotation by the rear section 3P but by a motor 17 arranged on the core barrel 1 of the invention, as described above, another operating mode can be obtained. During core sampling, the motor 17 is supplied with fluid arriving from the string 2 and running successively (FIG. 1 or 3) through the annular space 56, the channels 72 and 73, the pipe 76, the pipes 77 (FIG. 2), the pipe 11 and for example the nozzle 10 disposed at the inlet 42 to the motor 17. The fluid then leaves the motor 17 through its outlet 43 (FIG. 6) and is conveyed by various pipes 51 as far as the bit 5. It can be seen that, advantageously, advantage is taken of the internal thrust bearing of the motor 17 (between the stator 20 and rotor 21)

to transmit, to the front section 3A, the thrust forces of the pressure of fluid on the assembly 8 and in the motor 17, since these forces are transmitted precisely by the stator 20 and rotor 21. The internal thrust bearings of known motors are in fact in a position to withstand the forces necessary for this purpose.

It will be noted that, although the string 2 must not cause the bit 5 to rotate, it can be rotated at slow speed in order for example to prevent the string 2 sticking to the wall of the well.

If, for any reason known to experts, the bit 5 and/or the front section 3A oppose an excessive resisting torque at the motor 17, this causes the pressure upstream of the latter to be increased. The rated disc 54 can then be pierced when the pressure there reaches a limit safety value for the motor 17, and the fluid is diverted from the inlet 42 of the motor 17 to the conduit 51 and the outlet at the bit 5, and the motor 17 stops.

If on the other hand the front section 3A is pushed back for any reason in the section of external tube 3P at the point that the valve 45 (FIG. 3) leaves the valve seat 48, the fluid which arrives from the pipes 17 can escape between the valve 45 and the seat 48 to the pipe 51. The motor 17 is thus practically discharged of all fluid pressure since the latter is at this moment substantially equal at the inlet 42 and outlet 43 of the motor 17, so that at least the motor 17 and the bit 5 are no longer subjected to torques which could be harmful to them.

If the internal tube assembly 8 is pushed back upstream in the external tube 3, whether by the effect of a core which has jammed therein or by the effect of the front section 3A of the external tube pushing against the support stop 14, the throttling means 34 (FIG. 3) can come into action and, by throttling the passage of fluid, cause an appreciable increase in the pressure upstream of these means 34. This increase in pressure causes the warning explained above and the operator can once again adjust the flow of fluid and/or the advance of the string 2 accordingly.

As has been seen, three different protections for the motor 17 and bit 5 can be provided simultaneously or separately or in accordance with any combination of two amongst them.

If it is wished to raise the internal tube assembly 8, it is gripped in the usual fashion by an attachment device 67 (FIG. 1 or 3) and it is pulled on in the direction of the surface. This causes a sliding of the connecting bar 68 until one face 70A of the recess 70 comes into abutment against the stop spindle 71 fixed to the assembly 8. During said sliding, the connecting bar 68 pulls the sleeve 62 with it, by means of pins 79 (FIG. 2), and it separates the joint system 55 from the external tube 3, until it strikes against the assembly 8, for example in the position shown at 55R. Because of this, the fluid present in the external tube 3 makes practically no more obstacle to the raising of the internal tube assembly 8. In addition, the fluid can still escape for this purpose, where applicable, through channels 80 (FIG. 1 or 3), not yet described, at this time put opposite the channels 72 by the sliding of the connecting bar 68 upstream, in the assembly 8.

LEGEND TO FIGURES

S direction of advance of core sampling
1 core barrel
2 string
3 external tube
3A a front section of 3
3P rear section of 3
4 formation
5 annular core bit
8 internal tube assembly
9 internal tube proper
10 exchangeable nozzle
11 pipe
12A front stop on 3A
12P front stop on 3P
13A rear stop on 3A
13P rear stop on 3P
14 support stop
15 thrust ball bearing means/assembly
17 motor
18 rotation/sliding means/rings
19 rear part of 9
20 stator
21 rotor
26 catch and groove assembly
27 catch
28 groove
29 sloping longitudinal face of 28
31 catch and groove assembly
32 catch
33 groove
34 cooperating throttling means
35 annular protrusion on 9
36 internal annular rim on 3
39 fluid pipe system
40 external surface of 17
41 bypass pipe
42 inlet to 17
43 outlet from 17
45 valve
46 (position of) front stop on 9
47 (position of) rear stop on 9
48 valve seat
49 stop on 9
50 supply pipe
51 outlet pipe
54 closure valve/rated disc
55 joint system, active position
55R joint system, folded back position
56 annular space
57 joint
57*a* external edge of 57
57*b* petals on 57
57*c* gaps on 57
58 joint
58*a* external edge of 58
58*b* petals on 58
58*c* gaps on 58
62 sleeve
63 sensor
64 portion of 63
66 point of connection of sections of 3
67 attachment device
68 connecting bar
69 immobilisation pin
70 recess
70A front face of 70
70P rear face of 70
71 stop pin
72 channel
73 channel
74 joint
75 annular space
76 pipe

77 pipes
79 connecting pins between 62 and 68
80 channel

What is claimed is:

1. Core barrel, in particular for oil exploration, having:

a string (2), an external tube (3) fixed to the front end of the string (2), looking in the direction of advance (S) of the core barrel (1) in a formation (4), an annular core bit (5) mounted on a front section (3A) of the external tube (3), and an internal tube assembly (8) mounted in the external tube (3), so as to be able to be brought back to the surface through the string (2), and having hydrodynamic means arranged to convert a sampling fluid pressure circulating in the string (2) into a force for thrusting the said internal tube assembly (8) towards the front of the core barrel (1), characterized in that:

front section (3A) of the external tube (3) is mounted for axial sliding, limited by front stops (12A, 12B) and rear stops (13A, 13P), in a rear section (3P) of the same external tube (3) and projects longitudinally therefrom, the internal tube assembly (8) has a support stop (14) arranged to selectively push the front section (3A) of the external tube (3) forwards, means (15) are arranged between the internal tube (9) proper and the said front external tube section (3A) so that the latter can be driven in rotation about its longitudinal axis independently of the said internal tube (3), this being able to be held fixed in rotation with respect to the formation (3) being sampled.

2. Core barrel according to claim 1, characterised in that:

it has a motor (17) for rotating the front section (3A) of the external tube and the bit (5), means (18) are arranged between the said front section (3A) and the rear section (3P) of the external tube (3) so that one can be driven in rotation about its longitudinal axis independently of the other, the motor (17) is mounted in a rear part (19) of the internal tube assembly (8), the stator (20) of the motor (17) is fixed in rotation with respect to the rear section (3P) of the external tube (3), during core sampling, and the rotor (21) of the motor (17) is fixed in rotation to the front section (3A) of the external tube, during core sampling.

3. Core barrel according to claim 2, characterised in that the internal tube (9) proper is supported by the rotor (21) of the motor (17) by means of a thrust ball bearing assembly (15).

4. Core barrel according to any one or other of claim 2 or 3, characterised in that the stator (20) is kept fixed in rotation with respect to the rear section (3P) of the external tube (3) by at least one corresponding assembly (26) consisting of catch (27) and groove (28), the catch (27) advantageously being arranged to come into engagement in the groove (28) or to be released automatically therefrom when the internal tube assembly (8) is put in the core sampling position in the external tube (3) or is respectively withdrawn therefrom.

5. Core barrel according to any one or other of claim 2 or 3, characterised in that the rotor (21) is kept fixed in rotation with respect to the front section (3A) of the external tube (3) by at least one corresponding assembly (31) consisting of catch (32) and groove (33), the catch (32) advantageously being arranged to come into engagement in the groove (33) or to be automatically released therefrom when the internal tube assembly (8) is put in the core sampling position in the external tube (3) or is respectively withdrawn therefrom.

6. Core barrel according to any one or other of claim 1, 2 or 3, characterised in that there are provided, on the internal tube assembly (8) and in the external tube (3), cooperating means (34) for throttling the passage of the core sampling fluid, these throttling means (34) being arranged so as to be inactive during normal core sampling and so as to throttle the said passage in the case where the internal tube assembly (8) is pushed back in the external tube (3) in the opposite direction to the direction of advance (S) of the core sampling.

7. Core barrel according to any one or other of claim 2 or 3, characterised in that the motor (17) is of a type actuated by the core sampling fluid.

8. Core barrel according to claim 2 characterized in that the motor (17) participates in the aforementioned hydrodynamic means, at least for the part of a fluid which actuates it.

9. Core barrel according to claim 8, characterised in that:

it has a core sampling fluid bypass pipe (41) connected between an inlet (42) and an outlet (43) of the motor (17) for this fluid, the internal tube assembly (8) has, in the bypass pipe (41), a valve (45) mounted so as to be able to slide longitudinally between two stop positions, a front one (46) and a rear one (47), and the rear section (3P) of the external tube (3) has in the bypass pipe (41) a valve seat (48) fixed to the said rear section (3P), downstream of the valve (45), and arranged so as to cooperate with it so as to close off the bypass pipe (41) when the valve (45), in the rear stop position (47), is applied against the said seat (48) by the internal tube assembly (8) and when the valve (45), between the front (46) and rear (47) stop positions, is applied against the said seat (48) by the pressure of the fluid upstream in the bypass pipe (41), and so as to open the bypass pipe (41) when the valve (45), in the front stop position (46), is moved away from the seat (48) by the effect of the internal tube assembly (8) pushed upstream in the rear section (3P) of the external tube (3).

10. Core barrel according to claim 9, characterised in that it has, between a supply pipe (50) to the motor (17) and an outlet pipe (51) for the core sampling fluid, a closure valve (54) arranged to open in the event of overpressure at the inlet (42) to the motor (17), this valve (54) advantageously being a rated disc (54) which is pierced on overpressure.

11. Core barrel according to claim 9, characterised in that it has, to assist the internal tube assembly (8) to descend in the external tube (3), a joint system (55) mounted on the internal tube assembly (8) so as to substantially completely close off the annular space (56) between this assembly (8) and the external tube (3) and thus to receive, like a piston, the pressure of the drilling fluid.

12. Core barrel according to claim 11, characterised in that the joint system (55) has at least two flat circular joints (57, 58), whose external edge **(57*a*, 58*a*) is cut into a kind of petal (57*b*, 58*b*), the two joints (57, 58) being arranged one on the other so that a petal (57*b*, 58*b*) on one joint covers a gap (58*c*, 57*c*)** between two petals on the other joint.

13. Core barrel according to claim 11, characterised in that the internal tube assembly (8) has a sleeve (62) disposed upstream of the joint system (55), so as to be without action thereon during the descent of the internal tube assembly (8)

in the external tube (3) and during core sampling, but so as to slide previously upstream on the internal tube assembly (8) when the latter is withdrawn from the external tube (3) and then to move the joint system (55) away from the external tube (3).

14. Core barrel according to claim 9, characterised in that it is arranged to function according to two modes in which the front (3A) and rear (3P) sections can slide one in the other and in which the valve (45) is applied against the valve seat (48):

a coupled mode in which in addition the internal tube assembly (8) is applied in abutment against the rear section (3P), in the direction of core sampling advance (S), by the fluid pressure and in which the front section (3A) can come into abutment against the internal tube assembly (8) in the direction opposite to the direction of advance (S), and a decoupled mode, in which in addition the front section (3A) pushes, in the reverse direction to the aforementioned direction of advance (S), the internal tube assembly (8) away from the position in abutment against the rear section (3P).

15. Core barrel according to any one or other of claim 1, 2, 9, 10, 11, 12, or 14, characterised in that it has, in the internal tube (9) proper, a sensor (63) disposed so that a portion (64) thereof, equipped with measuring means, projects from this internal tube (9) during the descent of the internal tube assembly (8) in the external tube (3) and in the core sampling position of the internal tube (9) proper with respect to the external tube (3), this being away from a core sampling well bottom, and so that the sensor (63) can be pushed inside the internal tube (9) proper during a core sampling by the bottom of the well and/or by the top of the core.

16. A core barrel device for use in obtaining a core sample from a formation, comprising:

an axially extending tubular string having a front end, wherein the term "front" is determined relative to an axial direction of advance of said core barrel device into a formation from which a core sample is to be taken, an axially extending external tube coaxially fixed to said front end of said string, an axially extending front section of said external tube that extends coaxially through said external tube and projects from said front end of said external tube for selective movement axially relative to said external tube, an axially extending annular core bit coaxially mounted on said front section of said external tube, an axially extending internal tube assembly retrievably mounted coaxially in said external tube for retrieval through said string, an axially extending internal core tube mounted coaxially with said internal tube assembly, said internal core tube being mounted to be held fixed in rotation with respect to said formation and said front external tube section being driveable in rotation about a central axis independently of said internal core tube, and fluid flow passages in said core barrel device to convert a sampling fluid pressure flowing through said string into a thrust force for thrusting said internal tube assembly toward said front section of said external tube in response to said thrust force.

17. A core barrel device as defined in claim 16 further comprising a motor for rotating said front section of said external tube.

18. A core barrel device as defined in claim 16 further comprising a downhole motor adapted to be powered by a sampling fluid.

19. A core barrel device as defined in claim 16 wherein said front section of said external tube is rotatable relative to itself.

20. A core barrel device as defined in claim 17 wherein said motor is retrievably mounted with said internal tube assembly.

21. A core barrel device as defined in claim 17 wherein a rotor of said motor is connected through a bearing assembly to said internal core tube.

22. A core barrel device as defined in claim 20 further comprising a latch assembly for selectively securing said motor to said external tube.

23. A core barrel device as defined in claim 20 further comprising a latch assembly for selectively securing said motor to said front section of said external tube.

24. A core barrel device as defined in claim 20 further comprising a first latch mechanism for selectively securing a stator of said motor to said external tube and a second latch mechanism for selectively securing a rotor of said motor to said front section of said external tube.

25. A core barrel device as defined in claim 16 further comprising variable flow passage restrictions responsive to axial movement of said internal tube assembly for restricting a flow of a sampling fluid flowing through said core barrel device.

26. A core barrel device as defined in claim 16 wherein said core barrel device is responsive to a change in a fluid pressure of a sampling fluid caused by axial movement of said internal tube assembly.

27. A core barrel device said defined in claim 18 wherein a change in axial position of said inner assembly effects a pressure change in a sampling fluid flowing through said motor.

28. A core barrel device as defined in claim 16 where in s aid fluid flow passages are restricted by axial movement of said internal tube assembly.

29. A core barrel device as defined in claim 17 further comprising a fluid bypass connected between an inlet and an outlet of said motor for selectively bypassing a sampling fluid past said motor.

30. A core barrel device as defined in claim 29 further comprising a valve in said fluid bypass operable by axial movement of said internal tube assembly.

31. A core barrel device as defined in claim 30 further comprising an over-pressure control for limiting the maximum pressure of said sampling fluid at said inlet.

32. A core barrel device as defined in claim 16 further comprising a controllable flow restriction extending between said internal tube assembly and said external tube for selectively restricting the flow of a sampling fluid in an annular area between said internal tube assembly and said external tube.

33. A core barrel device as defined in claim 32 further comprising a restriction control for selectively decreasing the flow restriction between said internal tube assembly and said external tube.

* * * * *